US010204612B2

(12) United States Patent
Sim

(10) Patent No.: US 10,204,612 B2
(45) Date of Patent: Feb. 12, 2019

(54) HOLEY PLATE FOR SOUND ABSORPTION AND INSULATION

(71) Applicants: Hyundai Motor Company, Seoul (KR); Kia Motors Corporation, Seoul (KR)

(72) Inventor: Jae Gi Sim, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 54 days.

(21) Appl. No.: 15/374,681

(22) Filed: Dec. 9, 2016

(65) Prior Publication Data

US 2018/0166059 A1 Jun. 14, 2018

(30) Foreign Application Priority Data

Aug. 24, 2016 (KR) ..... 10-2016-0107674

(51) Int. Cl.
*G10K 11/172* (2006.01)

(52) U.S. Cl.
CPC ..... *G10K 11/172* (2013.01)

(58) Field of Classification Search
USPC ..... 181/288, 292, 293
See application file for complete search history.

(56) References Cited

U.S. PATENT DOCUMENTS

| | | | | | |
|---|---|---|---|---|---|
| 3,232,371 | A * | 2/1966 | Reichert | B41J 29/08 | 181/293 |
| 3,851,724 | A * | 12/1974 | Banks, Jr. | E04B 1/8409 | 181/208 |
| 4,073,991 | A * | 2/1978 | Focht | B32B 27/00 | 428/138 |
| 6,820,720 | B1 * | 11/2004 | Nicolai | B60R 13/02 | 181/292 |
| 7,467,680 | B2 * | 12/2008 | Mason | B60R 21/34 | 180/69.2 |
| 8,557,395 | B2 * | 10/2013 | Sunaga | B60R 13/0861 | 428/116 |
| 9,108,239 | B2 * | 8/2015 | Takahashi | B21D 13/10 | |
| 2009/0301811 | A1 * | 12/2009 | Wildhaber | B60R 13/0876 | 181/290 |
| 2011/0139542 | A1 * | 6/2011 | Borroni | B32B 3/266 | 181/290 |
| 2013/0133978 | A1 * | 5/2013 | Borroni | E04B 1/86 | 181/291 |

FOREIGN PATENT DOCUMENTS

| | | | |
|---|---|---|---|
| JP | 8-177477 | A | 7/1996 |
| KR | 10-2010-0103707 | A | 9/2010 |
| KR | 10-2013-0102320 | A | 9/2013 |
| KR | 10-2015-0115295 | A | 10/2015 |
| WO | WO 2010/007683 | A1 | 1/2010 |

* cited by examiner

*Primary Examiner* — Jeremy A Luks
(74) *Attorney, Agent, or Firm* — Morgan, Lewis & Bockius LLP

(57) ABSTRACT

A holey plate for sound absorption and insulation may include an array of through holes including a plurality of through holes having at least two different diameters, and the array of through holes being arrayed on the holey plate to form a predetermined pattern.

7 Claims, 5 Drawing Sheets

HOLEY PLATE FOR SOUND ABSORPTION AND INSULATION

CROSS REFERENCE TO RELATED APPLICATION

The present application claims priority to Korean Patent Application No. 10-2016-0107674, filed Aug. 24, 2016, the entire contents of which is incorporated herein for all purposes by this reference.

BACKGROUND OF THE INVENTION

Field of the Invention

The present invention generally relates to a holey plate for sound absorption and insulation. More particularly, the present invention relates to a holey plate for sound absorption and insulation, the plate being configured for absorbing sound and insulating from sound by using through holes.

Description of Related art

A composite panel that is constituted by an aluminum plate and sound absorbing and insulating material is generally used for a heat protector applied to a vehicle.

The composite panel is configured such that a sound absorbing and insulating material is filled between two aluminum plates, wherein rigidity is reinforced by the aluminum plate, and the sound absorbing and insulating material serves to insulate from heat, absorb sound, insulate from sound, and the like.

Here, when the simple planar aluminum plate is used, rigidity may low, so an embossed plate configured such that the aluminum plate is formed with concave-convex surface in order to reinforce rigidity.

A conventional plate is, for example, configured such that a hexagonal convex cell is arrayed to form a honeycomb structure in order to maximize rigidity. However, the conventional plate is problematic in that processability thereof is low, and accordingly it is difficult to manufacture a heat protector having a desirable shape.

Further, by using the composite panel simply filled with the sound absorbing and insulating material, it is difficult to achieve satisfactory sound absorption and insulation performance.

In order to improve sound absorption and insulation performance, a holey plate configured such that holes are made in the aluminum plate has been disclosed. However, the conventional holey plate is problematic in that sound absorption and insulation performance is limited.

Thus, an improved plate for sound absorption and insulation capable of solving the above problems is required.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a holey plate for sound absorption and insulation configured for absorbing and insulating from wide frequency range sound.

In an aspect of the present invention, there is provided a holey plate for sound absorption and insulation, wherein the holey plate is provided with embossments, the holey plate including: an array of through holes having a plurality of through holes having at least two kinds of diameters, and the array of through holes being arrayed on the holey plate to form a predetermined pattern.

The array of through holes may be configured such that the plurality of through holes is arrayed to form an imaginary regular hexagonal pattern, wherein a plurality of regular hexagonal patterns is arrayed to form a honeycomb structure.

The array of through holes may be configured such that a biggest through hole of the array is formed in a center of the imaginary regular hexagonal pattern, and a diameter of a through hole is gradually reduced as it moves away from the center of the imaginary regular hexagonal pattern.

The holey plate may be provided with convex first cells and concave second cells in plural to form the embossments; and the array of through holes may have a size different from sizes of the first cells and the second cells.

The first cells may be in a hexagonal shape; and in the holey-plate, a plurality of first cells may be arrayed in a row in a longitudinal direction, wherein adjacent first cells share a first side thereof, and a plurality of first cells may be arrayed in a row in a lateral direction such that adjacent first cells share one vertex.

The second cells may be in a rhombic shape, and provided in areas formed by sides of the first cells except the sides shared by the adjacent first cells.

A height of each of the first cells and a depth of each of the second cells may be 0.05~0.25 times a length of each of the sides of the first cells.

A length of each of the sides of the first cells may be 3~15 mm.

The holey plate for sound absorption and insulation according to an exemplary embodiment of the present invention is advantageous for the following reasons.

Firstly, it is possible to absorb and insulate from wide frequency range sound by using various sized through holes.

Secondly, it is possible to reinforce rigidity by using cells in hexagonal and rhombic shapes.

Thirdly, it is possible to have better formability through modified arrangement than that of through arrangement of the honeycomb structure.

Fourthly, it is possible to easily manufacture thanks to a simple structure.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
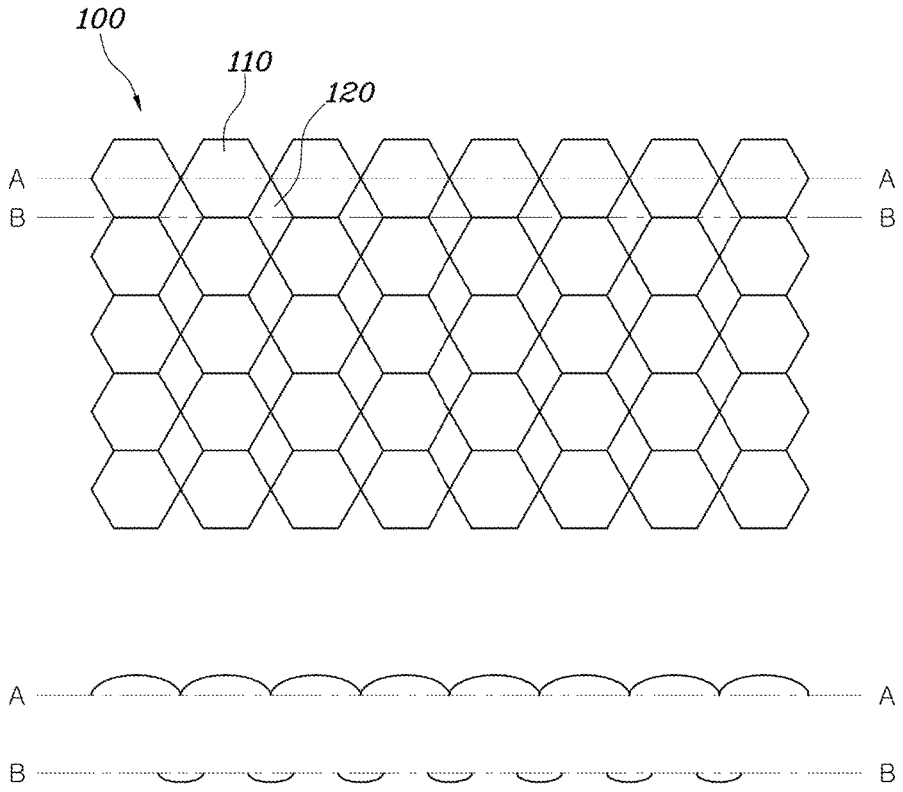
FIG. 1 is a plane view and a side sectional view showing a holey plate according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not the exemplary embodiments, but also various alternatives, modifications, equivalents and other embodiments, which may be included within the spirit and scope of the invention as defined by the appended claims.

The terminology used herein is for the purpose of describing particular embodiments only and is not intended to be limiting of the present invention. As used herein, the singular forms are intended to include the plural forms as well, unless the context clearly indicates otherwise. It will be further understood that the terms "comprises", "comprising", "includes", and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which the present invention belongs. It will be further understood that terms used herein should be interpreted as having a meaning that is consistent with their meaning in the context of this specification and the relevant art and will not be interpreted in an idealized or overly formal sense unless expressly so defined herein.

Reference will be made to a holey plate for sound absorption and insulation according to an exemplary embodiment of the present invention with reference to the accompanying drawings, hereinbelow.

Figure 2:
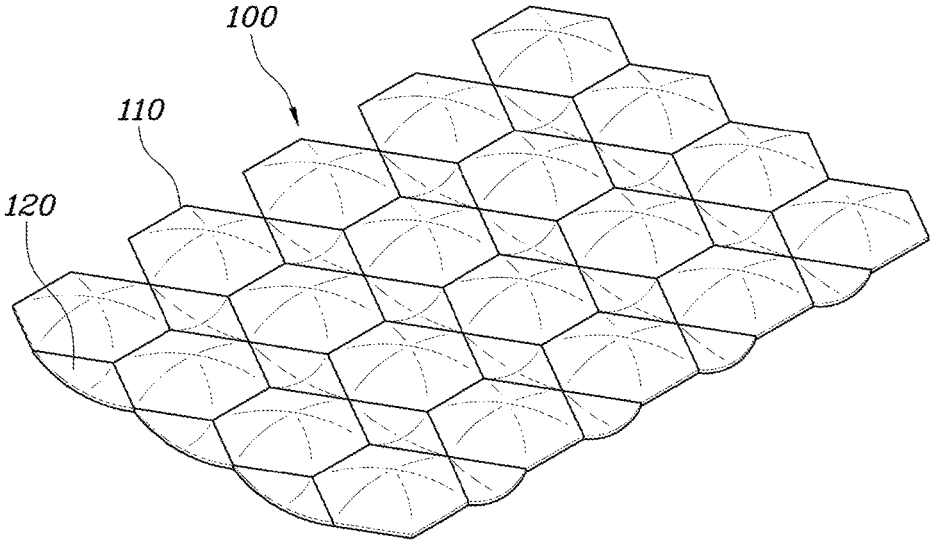
FIG. 2 is a perspective view showing the holey plate according to the exemplary embodiment of the present invention.

FIG. 1 and FIG. 2 are views showing a holey plate according to an exemplary embodiment of the present invention. For reference, in FIG. 1 and FIG. 2, through holes and a pattern formed by an array of through holes, which will be described hereinafter, are omitted. The through holes and the array of through holes will be described with reference to FIGS. 3 to 5.

Figure 3:
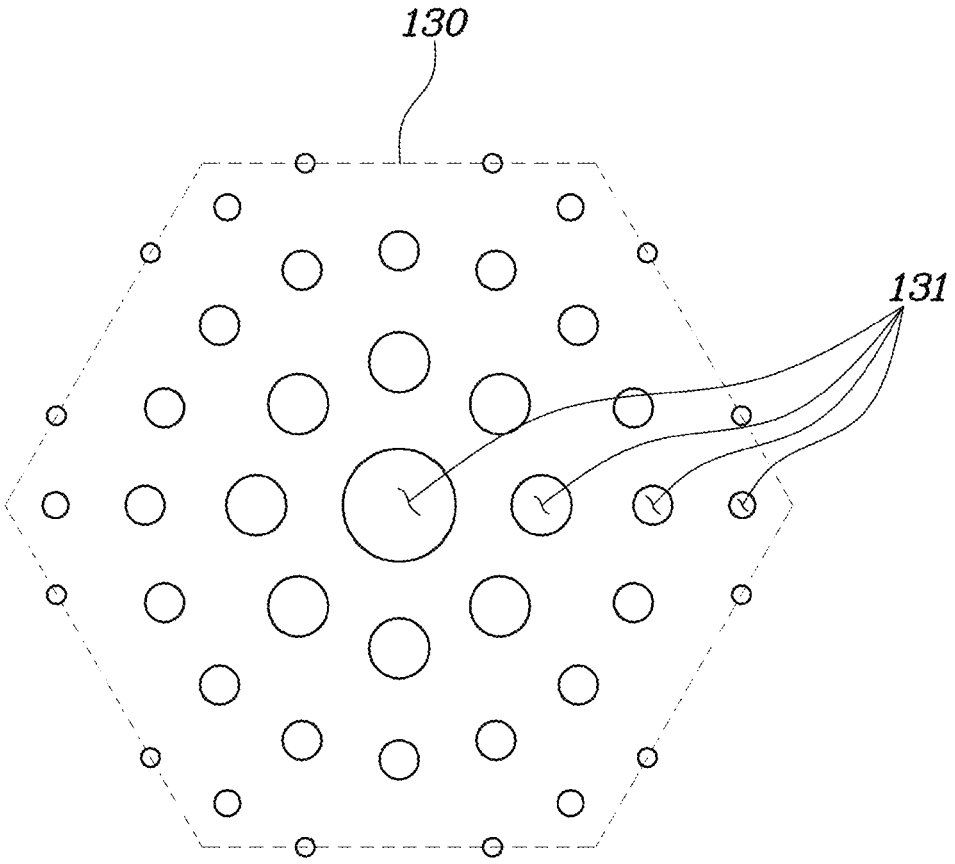
FIG. 3 is a view showing a pattern of an array of through holes according to the exemplary embodiment of the present invention.
Figure 4:
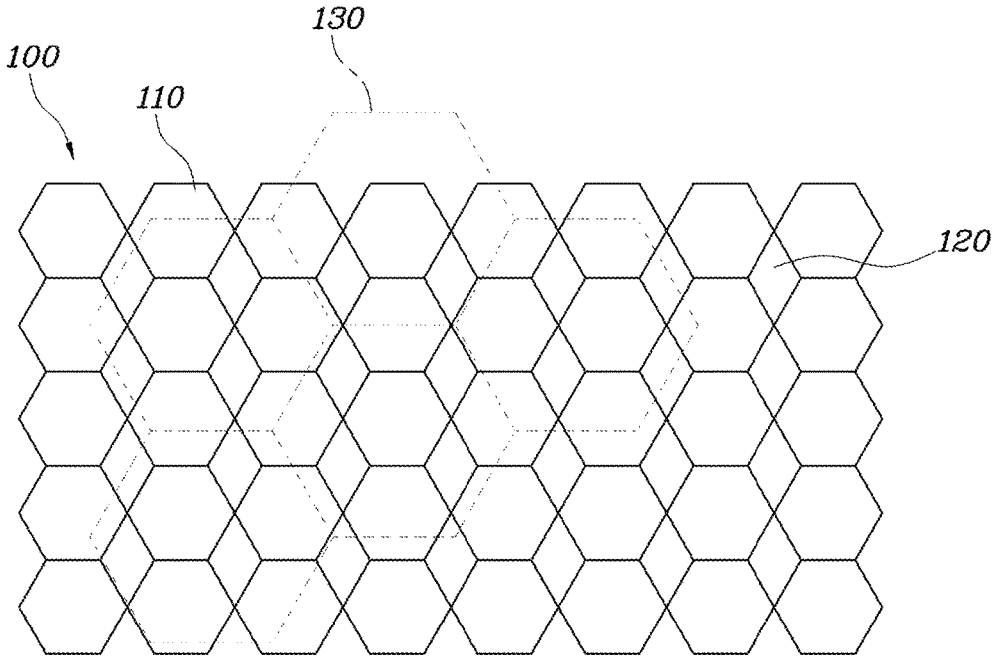
FIG. 4 and FIG. 5 are views showing a state where the pattern of the array of through holes is arrayed in the holey plate.
Figure 5:
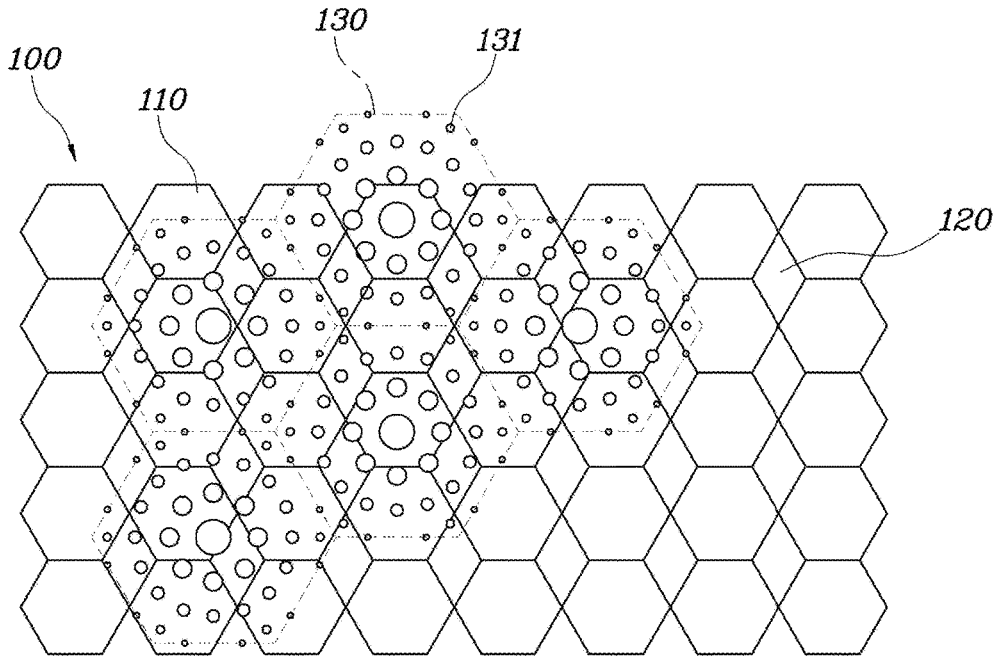

As shown in FIGS. 3 to 5, a holey plate 100 for sound absorption and insulation 100 according to an exemplary embodiment of the present invention includes an array of through holes 130 having a plurality of through holes 131 having at least two kinds of diameters, and the array of through holes being arrayed on the holey plate to form a predetermined pattern.

The through holes 131 are holes penetrating through the holey plate 100, wherein the frequency of sound, which will be absorbed and insulated from, is determined by the sizes of the through holes 131. In an exemplary embodiment of the present invention, the through holes 131 are formed in variable sizes to absorb and insulate from various sounds having different frequencies.

The array of through holes 130 having the various sized through holes 131 is arrayed on the holey plate 100 to form a predetermined pattern, and thereby it is possible to achieve sound absorption and insulation performance equally throughout the holey plate 100.

To be more specific to the pattern formed by the array of through holes 130, the array of through holes 130 is arrayed to form an imaginary regular hexagon. In the exemplary embodiment, a plurality of imaginary regular hexagons is arrayed on the holey plate 100 to form a honeycomb structure.

The imaginary regular hexagon formed by the array of through holes 130 is not a shape or part that is actually provided on the holey plate 100 but an imaginary shape that serves as a unit cell of the array of through holes 130.

By arraying the array of through holes 130 to form a honeycomb structure, it is possible to perform sound absorption and insulation equally throughout the holey plate 100. In other words, the various sized through holes 131 are arrayed on the holey plate 100 at a predetermined density, and thereby it is possible to efficiently absorb and insulate from various sounds having different frequencies.

The through holes 131 arrayed on the array of through holes 130 may have various patterns. As an example of a pattern, the array of through holes may be configured, wherein a biggest through hole of the array is formed in a center of the imaginary regular hexagon, smallest through holes of the array are formed at an edge of the imaginary regular hexagon, and therebetween, through holes having a diameter reduced as they move away from a center of the imaginary regular hexagon are sequentially formed on the imaginary regular hexagon.

By arraying the various sized through holes 131 to form a concentric circular shape, it is possible to efficiently absorb and insulate from wide frequency range sound.

Further, as described above, the regular hexagon formed by the array of through holes 130 is arrayed to form a honeycomb structure, that is, the array of through holes 130 and the through holes 131 are arrayed to form a predetermined pattern throughout the holey plate 100.

As shown in FIG. 1 and FIG. 2, the holey plate 100 may have an embossed structure, in which convex first cells 110 and concave second cells 120 are arrayed regularly.

The first cells 110 are each configured to be in a hexagonal shape having six sides, with the center thereof protruding, wherein when looking at each of the first cells from the side, an arc-shape can be viewed between corresponding vertexes.

The second cells 120 are each configured to be in a rhombic shape having four sides, with the center thereof protruding in a direction opposite to the first cells 110, wherein when looking at each of the second cells from the side, an arc-shape can be viewed between corresponding vertexes first as in the first cells 110.

To prevent arrangements of the first cells 110 and the second cells 120 from overlapping with arrangements of the array of through holes 130, it is exemplary that the array of through holes 130 has a size different from sizes of the first cells 110 and the second cells 120.

In other words, for example, when each of the first cells 110 has a size equal to a size of the array of through holes 130, an overlapping area between each of the first cells 110 and the array of through holes 130 is repeatedly formed, which makes the shape of the through holes 131 regular, and thereby it may limit frequencies of sound to be absorbed and insulated against.

However, when the array of through holes 130 has a size different from sizes of the first cells 110 and the second cells 120, it is possible to minimize the overlapping area between each of the first cells 110 and the second cells 120, and the array of through holes 130, which makes the shape of the through holes 131 irregular. Accordingly, it is possible to improve sound absorption and insulation performance by widening frequencies of sound to be absorbed and insulated from.

The first cells 110 have a modified structure from a honeycomb structure, wherein a plurality of first cells is arrayed in a row in a longitudinal direction, wherein adjacent first cells 110 share a first side thereof, and a plurality of first cells is arrayed in a row in a lateral direction such that adjacent first cells 110 share one vertex.

Accordingly, it is possible to easily process the plate improve to be in a desirable shape due to improved formability, while having lower rigidity than the embossed plate having a honeycomb structure.

Each of the second cells 120 is surrounded by four different first cells 110. According to the above described arrangement of the first cells 110, each of the first cells 110 shares sides with two adjacent first cells 110, and shares vertexes with another two adjacent first cells 110, wherein each of the first cells 110 has four sides that are not shared by the adjacent first cells 110.

The sides that are not shared by the adjacent first cells 110 form sides of the rhombic shape of each of the second cells 120.

It is exemplary that a height of each of the first cells 110 and a depth of each of the second cells 120 are 0.05~0.25 times a length of each of the sides of the first cells 110.

When the height and the depth are below 0.05 times a length of each of the sides of the first cells 110, rigidity reinforcement effect that is achieved by the shape of each cell may be low, and on the contrary, when the height and the depth are over 0.25 times a length of each of the sides of the first cells 110, the plate may be damaged, such as breakage, during embossing processing, or may be damaged or poorly formed during additional forming processing.

To be more specific, it is exemplary that a length of each of the sides of the first cells 110 is 3~15 mm.

When a length of each of the sides of the first cells is below 3 mm, the number of processing steps is increased, and thereby processing cost is increased, causing inefficiency, which may pose a problem, such as low formability, during forming processing of the finished product. On the contrary, when a length of each of the sides of the first cells is over 15 mm, a size of the pattern of each cell is overly big, and thereby the rigidity reinforcement effect may be low.

Accordingly, it is preferred that a length of each of the sides of the first cells 110 is 3~15 mm, and more in the exemplary embodiment, the length is limited to 5~10 mm.

Although an exemplary embodiment of the present invention has been described for illustrative purposes, those skilled in the art will appreciate that various modifications, additions and substitutions are possible, without departing from the scope and spirit of the invention as disclosed in the accompanying claims.

For convenience in explanation and accurate definition in the appended claims, the terms "upper", "lower", "inner", "outer", "up", "down", "upper", "lower", "upwards", "downwards", "front", "rear", "back", "inside", "outside", "inwardly", "outwardly", "interior", "exterior", "inner", "outer", "forwards", and "backwards" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A holey plate for sound absorption and insulation, wherein the holey plate is provided with embossments, the holey plate comprising:

an array including a plurality of through holes having at least two different diameters, and the array of through holes being arrayed on the holey plate to form a predetermined pattern, wherein a plurality of regular hexagonal patterns is arrayed on the holey plate to form a honeycomb pattern, and wherein the array of through holes is arrayed to form the predetermined pattern having an imaginary regular hexagonal pattern.

2. The holey plate of claim 1, wherein the array of through holes is configured such that a biggest through hole of the array among the through holes is formed in a center of the imaginary regular hexagonal pattern, and diameters of remaining through holes among the through holes are reduced as being away from a center of the imaginary regular hexagonal pattern.

3. The holey plate of claim 1, wherein the holey plate is provided with convex first cells and concave second cells in plural to form the embossments; and the array of through holes has a size different from sizes of the first cells and the second cells.

4. The holey plate of claim 3, wherein the first cells are in a hexagonal shape; and in the holey-plate, a plurality of first cells is arrayed in a row in a longitudinal direction such that adjacent first cells share a first side thereof, and a plurality of first cells is arrayed in a row in a lateral direction such that adjacent first cells share one vertex.

5. The holey plate of claim 4, wherein the second cells are in a rhombic shape, and provided in areas formed by sides of the first cells except sides shared by the adjacent first cells.

6. The holey plate of claim 4, wherein a height of each of the first cells and a depth of each of the second cells are 0.05~0.25 times a length of each of the sides of the first cells.

7. The holey plate of claim 4, wherein a length of each of the sides of the first cells is between 3 mm and 15 mm.

* * * * *